US007940237B2

(12) United States Patent
Hu

(10) Patent No.: US 7,940,237 B2
(45) Date of Patent: May 10, 2011

(54) PANEL DISPLAY DEVICE WITH SINGLE ADJUSTABLE RESISTOR TO TUNE THE BRIGHTNESS OF THE PIXEL

(75) Inventor: Shuo-Hsiu Hu, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 888 days.

(21) Appl. No.: 11/263,937

(22) Filed: Nov. 2, 2005

(65) Prior Publication Data

US 2006/0267883 A1 Nov. 30, 2006

(30) Foreign Application Priority Data

May 27, 2005 (TW) ..... 94117587 A

(51) Int. Cl.
*G09G 3/32* (2006.01)

(52) U.S. Cl. ..... 345/82; 345/690; 315/169.3

(58) Field of Classification Search ..... 345/92, 345/90, 76–84, 204–208, 690, 211–214; 315/169.1–169.4
See application file for complete search history.

(56) References Cited

U.S. PATENT DOCUMENTS

| | | | | |
|---|---|---|---|---|
| 4,166,213 | A * | 8/1979 | Hoover | 250/214 VT |
| 4,358,713 | A * | 11/1982 | Senoo et al. | 315/291 |
| 5,754,150 | A * | 5/1998 | Matsui | 345/89 |
| 6,225,992 | B1 * | 5/2001 | Hsu et al. | 345/211 |
| 6,897,621 | B2 * | 5/2005 | Park | 315/169.3 |
| 7,295,192 | B2 * | 11/2007 | Hu | 345/176 |
| 7,385,572 | B2 * | 6/2008 | Yu et al. | 345/76 |
| 2002/0149575 | A1 * | 10/2002 | Moon | 345/204 |
| 2002/0186230 | A1 * | 12/2002 | Kudo et al. | 345/690 |
| 2003/0058235 | A1 * | 3/2003 | Moon | 345/212 |
| 2003/0146887 | A1 * | 8/2003 | Mametsuka | 345/76 |
| 2004/0104874 | A1 * | 6/2004 | Monomohshi | 345/87 |
| 2005/0012698 | A1 * | 1/2005 | Takahashi | 345/77 |
| 2005/0134302 | A1 * | 6/2005 | Pan et al. | 324/770 |
| 2005/0200584 | A1 * | 9/2005 | Kudo et al. | 345/89 |
| 2006/0114205 | A1 * | 6/2006 | Shen et al. | 345/88 |

* cited by examiner

*Primary Examiner* — Alexander S Beck
*Assistant Examiner* — Liliana Cerullo
(74) *Attorney, Agent, or Firm* — WPAT, P.C.; Anthony King

(57) ABSTRACT

A panel display device structure comprises a plurality of pixels and a modulation unit. Each of the pixels comprises a thin film transistor and a light generation device, and the thin film transistor connects to the light generation device. The modulation unit connects to the thin film transistor and makes a signal transformation curve of the pixel to vertically shift in order to adjust the brightness of the pixel by modulating external voltage signal relied on a voltage dividing way or a direct current voltage transfer circuit, so as to satisfy the demand of increasing shifting range of the signal transformation curve.

10 Claims, 8 Drawing Sheets

PANEL DISPLAY DEVICE WITH SINGLE ADJUSTABLE RESISTOR TO TUNE THE BRIGHTNESS OF THE PIXEL

FIELD OF THE INVENTION

The present invention relates to a flat panel display device structure, and more particularly, to a flat panel display device structure comprising a modulation unit which modulates the pixel brightness of the flat panel display device structure.

BACKGROUND OF THE INVENTION

The utilization of flat panel display devices is popular and widespread. The flat panel display devices are usually employed in flat panel TVs, mobile phones, PDAs, digital cameras, display panels in automobiles, and projectors.

Referring to FIG. 1, it is a diagram illustrating a flat panel display device structure in prior art, comprising a thin film transistor (TFT) 11; a light generation device 12 wherein one terminal of the light generation device 12 couples with a drain 112 of TFT 11; and a modulation unit 13 wherein an output couples with a gate 111 of TFT 11. Users can change an input signal 131 of the modulation unit 13 to modify an output signal 132 based on a signal transformation curve. The TFT 11 outputs current into the light generation device 12 from the drain 112 in accordance with the input signal of the gate 111 and the threshold voltage between the gate 111 and the drain 112. The light intensity of the light generation device 12 increases as the input current of the light generation device 12 raises.

Referring to FIG. 2, it is a graph illustrating the signal transformation curve in a coordinate, wherein the horizontal axis represents the input signal 131 which can be a digital signal and the vertical axis represents the mentioned output signal 132 which can be an analog voltage output. The signal transformation curve 21 representing the corresponding relationship between the input signal 131 and the output signal 132 is similar to a Gamma curve. Users input the input signal 131 in the modulation unit 13 to produce a corresponding output signal 132.

Referring to FIG. 3, it is a modulation unit known as a prior art, comprising two adjustable resistors 31, 32 and resistors in serial 33 wherein the resistors in serial 33 comprises a plurality of resistors in serial and a plurality of voltage bias points 34. One terminal of the adjustable resistor 31 is connected to a highest input voltage 35 with a highest voltage point 36. One terminal of the other adjustable resistor 32 is connected to a lowest input voltage 37 with a lowest voltage point 38. The modulation unit provides a highest voltage output as the same as the voltage value of the highest voltage point 36 and a lowest voltage output as the same as the voltage value of the lowest voltage point 38. The voltage values of the voltage bias points 34 are limited between the highest voltage and the lowest voltage outputted by the modulation unit. It is known as a prior art that there are provided n voltage bias values in a modulation unit where n is a number of 2 to the power of n, i.e. 2^n, and the n-th voltage bias value can be outputted according to the digital input, i.e. n th voltage bias, from users. The relationship between the digital inputs and analog outputs are described in the signal transformation curve in FIG. 2. In a word, users can change the voltage bias value of the voltage bias points 34 by modifying the resistance values of the adjustable resistors 31, 32.

Referring to FIG. 4, it is a graph illustrating the signal transformation curve in a coordinate with the modulation unit described to FIG. 3 wherein the horizontal axis represents an input signal 41 and the vertical axis represents an output signal 42. The signal transformation curve 43 represents the corresponding relationship between input signals 41 and output signals 42. While decreasing the resistance value of the adjustable resistor 33, the left part of the signal transformation curve 43 moves toward the direction A. While increasing the resistance value of the adjustable resistor 33, the left part of the signal transformation curve 43 moves toward the direction B. It is similar that while decreasing the resistance value of the adjustable resistor 34, the right part of the signal transformation curve 43 moves toward the direction C. While increasing the resistance value of the adjustable resistor 34, the right part of the signal transformation curve 43 moves toward the direction D. Thus, the curvature and linearity of the signal transformation curve 43 can be changed, i.e. the relationship between input signals 41 and output signals 42, by tuning the resistance values of the adjustable resistors 33, 34. When the characteristics of the TFT coupling with the modulation unit are fine tuned so as to have a proper signal transformation curve 43, the light generation device coupling with the TFT obtains an expectable current value and an appropriate light intensity.

Although the modulation units mentioned above can tune the signal transformation curve, the range of modification of the signal transformation curve is restricted by adjusting the adjustable resistors. In fact, during the manufacturing process of the flat panel display devices, the drafting effect makes the threshold voltages of each TFT on the flat panel display devices different. The light intensity of the light generation devices is not acceptable due to the inputting current of the light generation devices is not exact the same, even all of the inputting voltages on the gates of the TFT transistors are precisely the same. The difference of the threshold voltage between TFT transistors is created by the conditions of manufacturing environment in reality. The difference can be about 1 voltage and causes the display quality of the flat panel display devices and light intensity of the display devices are undesirable.

It is an objective of the present invention to provide a flat panel display device structure including a modulation unit for adequately shifting vertically the signal transformation curve to solve the restricted shifting of the signal transformation curve in prior art. Another flat panel display device structure containing a modulation unit is disclosed, too.

SUMMARY OF THE INVENTION

The present invention provides a flat panel display device structure, comprising a plurality of pixels which includes a thin film transistor (TFT) and a light generation unit coupling with the TFT; and a modulation unit coupling with one terminal of the TFT and used for tuning the light intensity of the pixels by shifting vertically the signal transformation curve related to the pixels. Moreover, the modulation unit employs the voltage levels divided by resistors or voltage levels converted from direct current (DC) circuits to vary the voltage levels of external voltage signals applied on the modulation unit and then shifts the signal transformation curve vertically.

Furthermore, the flat panel display device structure can satisfy the demands on the wide variation range of the signal transformation curve and improve the display quality of the flat panel display devices.

The features and advantages of the present invention are described in detail and pictorially from the following descriptions and accompanying drawings.

DETAILED DESCRIPTION OF THE PREFERRED EMBODIMENTS

Figure 1:
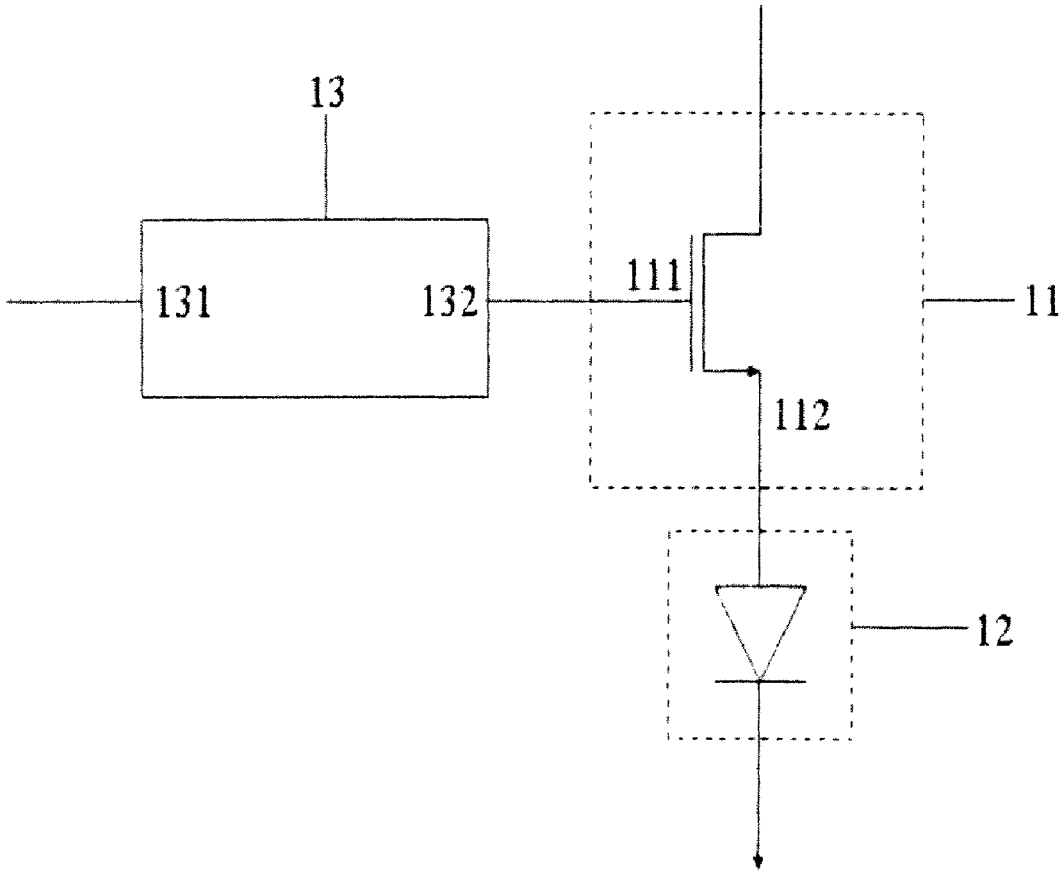
Fig.1 PRIOR ART
FIG. 1 is a diagram of a flat panel display device structure in prior art.
Figure 2:
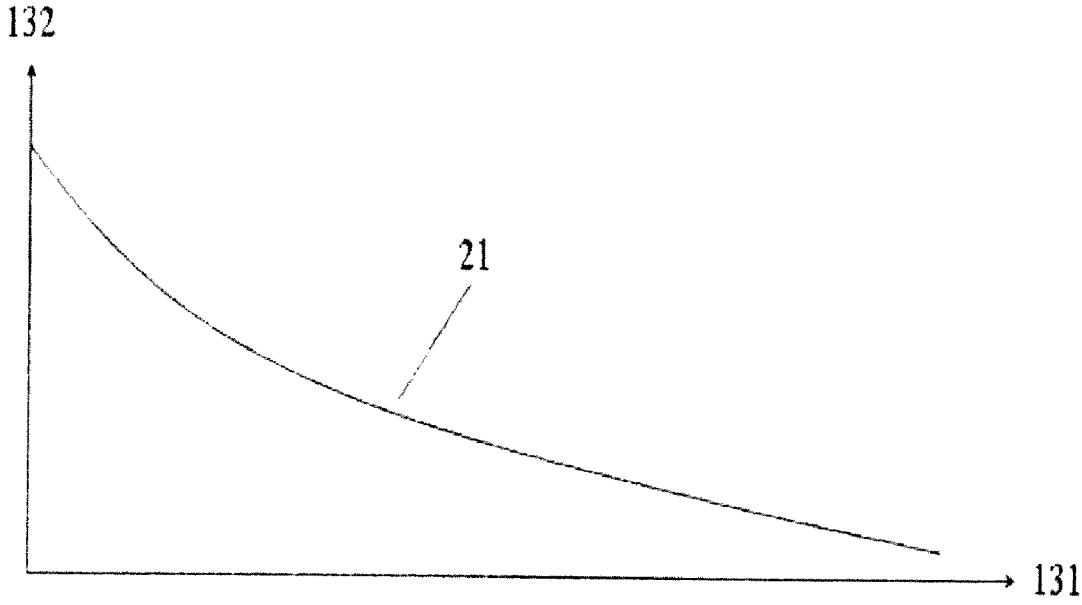
Fig.2 PRIOR ART
FIG. 2 is a graph illustrating the signal transformation curve in a coordinate.
Figure 3:
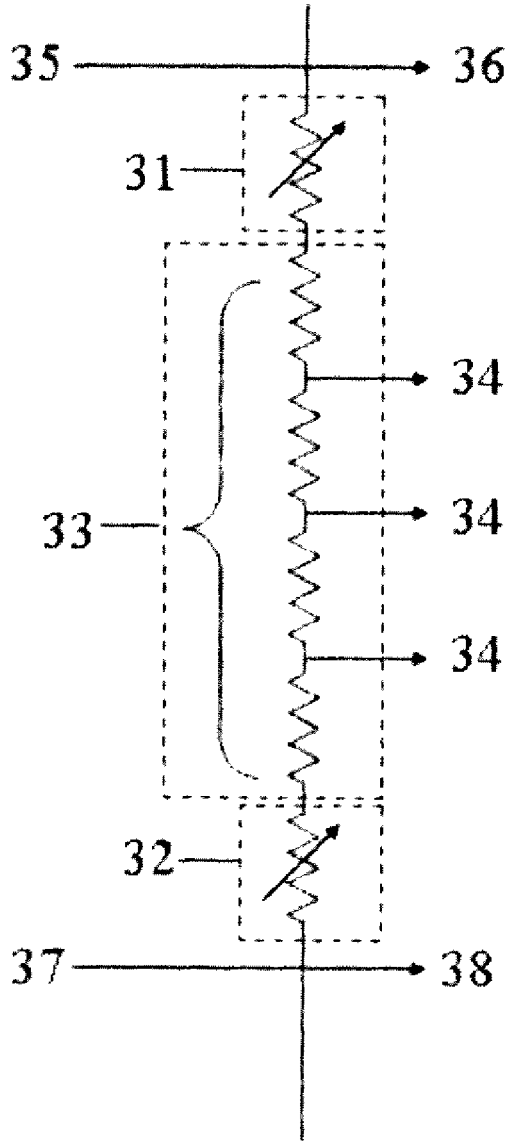
Fig.3 PRIOR ART
FIG. 3 illustrates a modulation unit in prior art.
Figure 4:
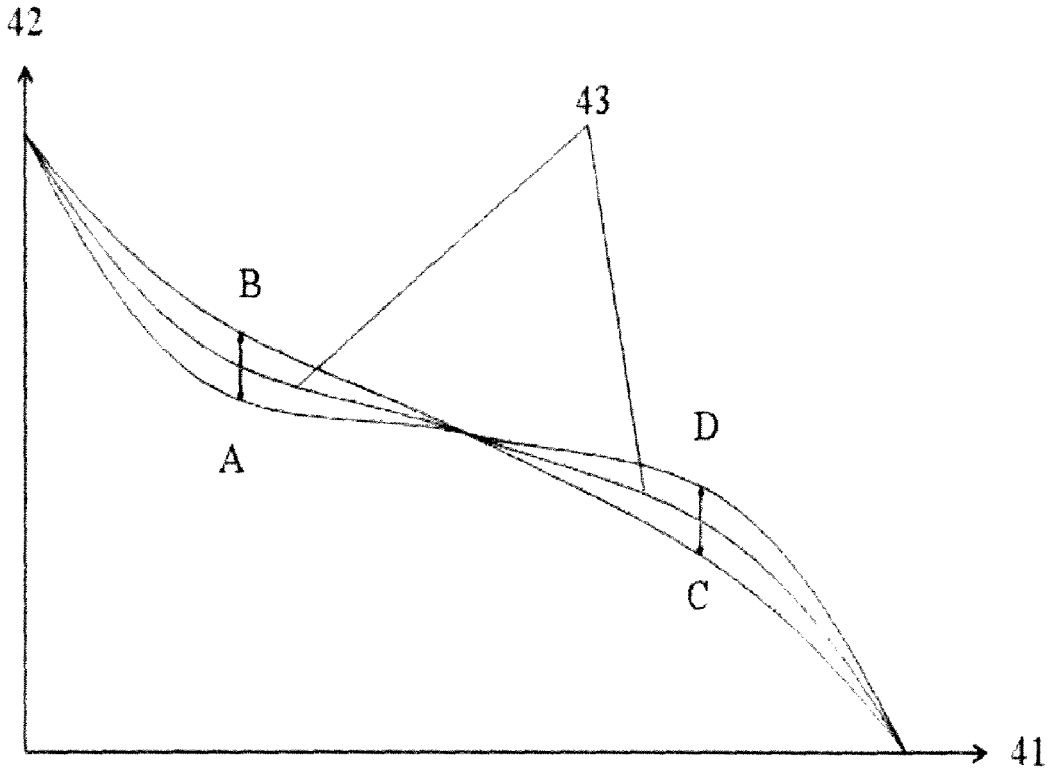
Fig.4 PRIOR ART
FIG. 4 is a graph illustrating the signal transformation curve in a coordinate with modulation units described to FIG. 3.
Figure 5:
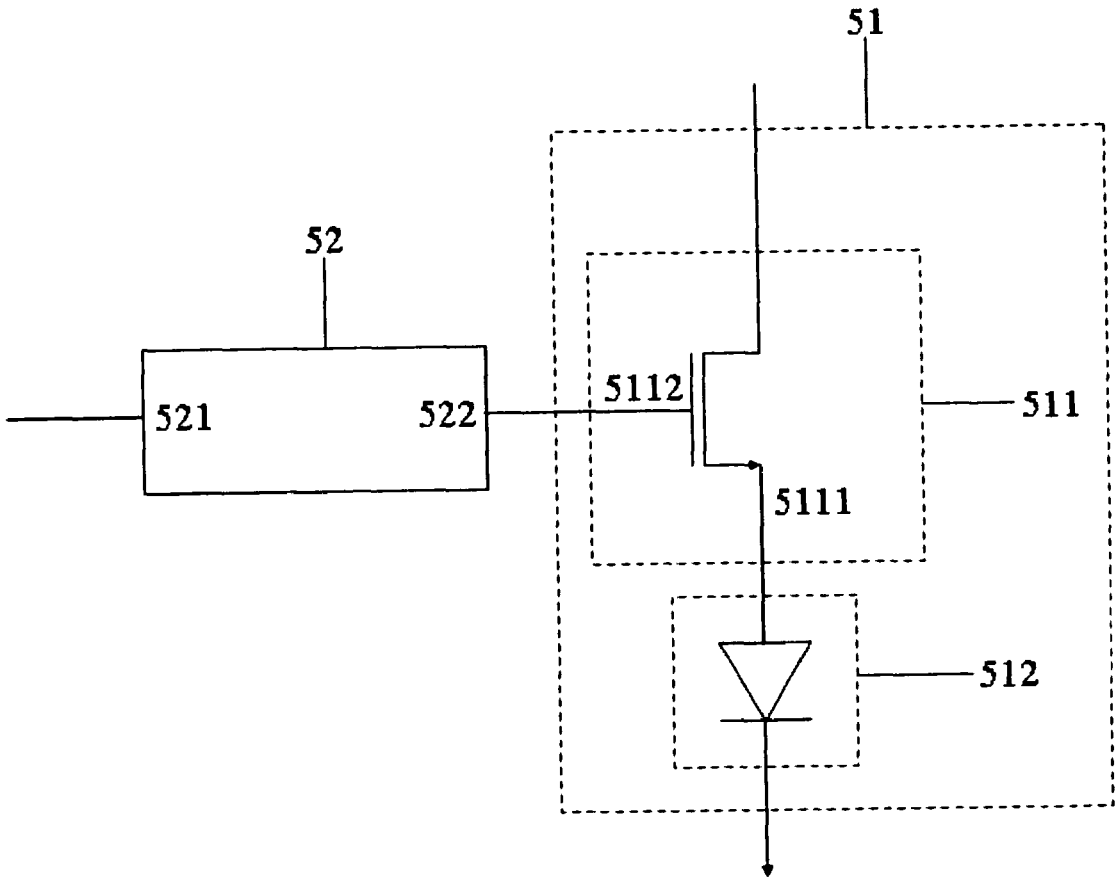
FIG. 5 is a diagram of a flat panel display device structure according to the present invention.

In FIG. 5, it is a diagram of a flat panel display device structure according to the present invention. The structure comprises a pixel 51 and a modulation unit 52. The pixel 51 includes a thin film transistor (TFT) 511 and the light generation device 512 wherein the drain of TFT 511 couples with the light generation device 512 serially. Moreover, the output of the modulation unit 13 couples with the gate 5112 of the TFT 511. Users change the output signal 522 according to the signal transformation curve of the pixel 51 by tuning the input signal 521 of the modulation unit 52. Thus, the current flowing through the light generation device 512 via a drain 5111 is determined by an input signal of gate 5112 and the threshold voltage between the gate 5112 and the drain 5111. Finally, the light intensity of pixel 51 which means the light intensity of the light generation device 512 is determined by the current flowing through the light generation device 512. The light intensity of pixel 51 can also be changed by modifying the modulation unit 52 and shifting the signal transformation curve of the pixel 51 vertically. Furthermore, the modulation unit 512 can be included in a driver IC, i.e. integrated circuit. If the light generation device 512 is made of OLED (organic light emitting diode) elements, the flat panel display device can be an OLED display apparatus.

Figure 6:
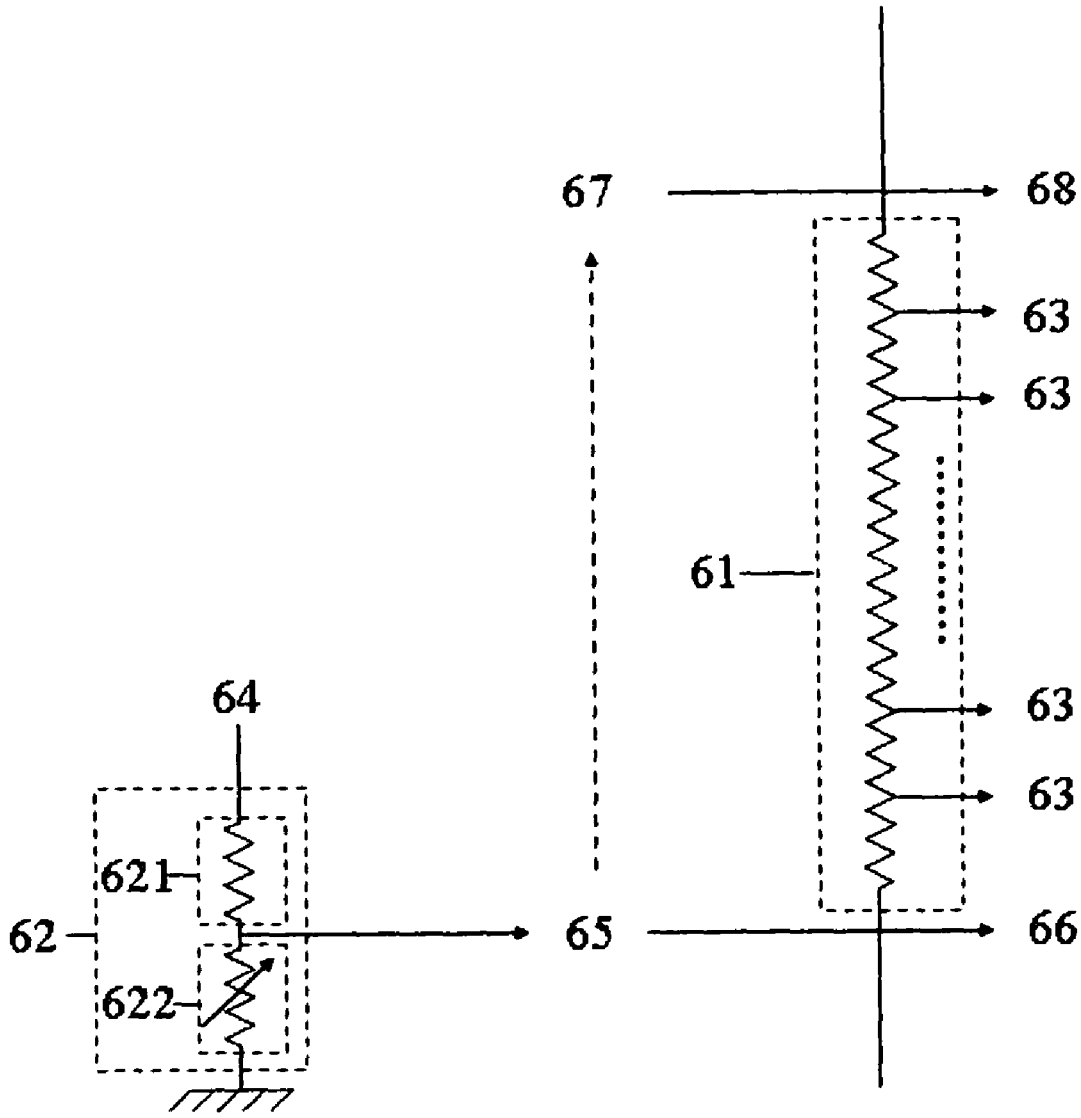
FIG. 6 is a diagram illustrating a modulation unit according to the present invention.

FIG. 6 illustrates a modulation unit according to the present invention, comprising at least one combination of resistors in serial 61 formed by connecting a plurality of resistors serially and voltage-divided module 62. Moreover, the voltage-divided module 62 includes a resistor 621 wherein one terminal of the resistor 621 is able to couple with an external voltage signal 64; and an adjustable resistor 622 wherein one terminal of the adjustable resistor 622 can be connected to a ground. A lowest voltage level 65 outputted from adjustable resistor 622 by changing the resistance ratio to modify the voltage bias 64 is connected to one terminal of the serial-connected resistors 61 at the point 66 where a lowest voltage bias level is provided. The highest output voltage level 67 can be the voltage value of the lowest voltage value 65 plus a specific voltage value or can be a multiple of the lowest voltage value 65. Moreover, a highest voltage value point 68 is provided by connecting the highest output voltage 67 to one terminal of the serial-connected resistors 61. Therefore, the modulation unit provides a highest voltage value equivalent to the value of highest voltage point 68, a lowest voltage value equivalent to the value of the lowest voltage point 66, and a plurality of voltage points 63 whose voltage values are between the highest voltage and lowest voltage provided by the modulation unit. By changing the resistance value of the adjustable resistor 622, the voltage values of the highest voltage point 68, the lowest voltage point 66 and a plurality of voltage points 63 can increase or decrease simultaneously and consequently, shift the signal transformation curve vertically.

Figure 7:
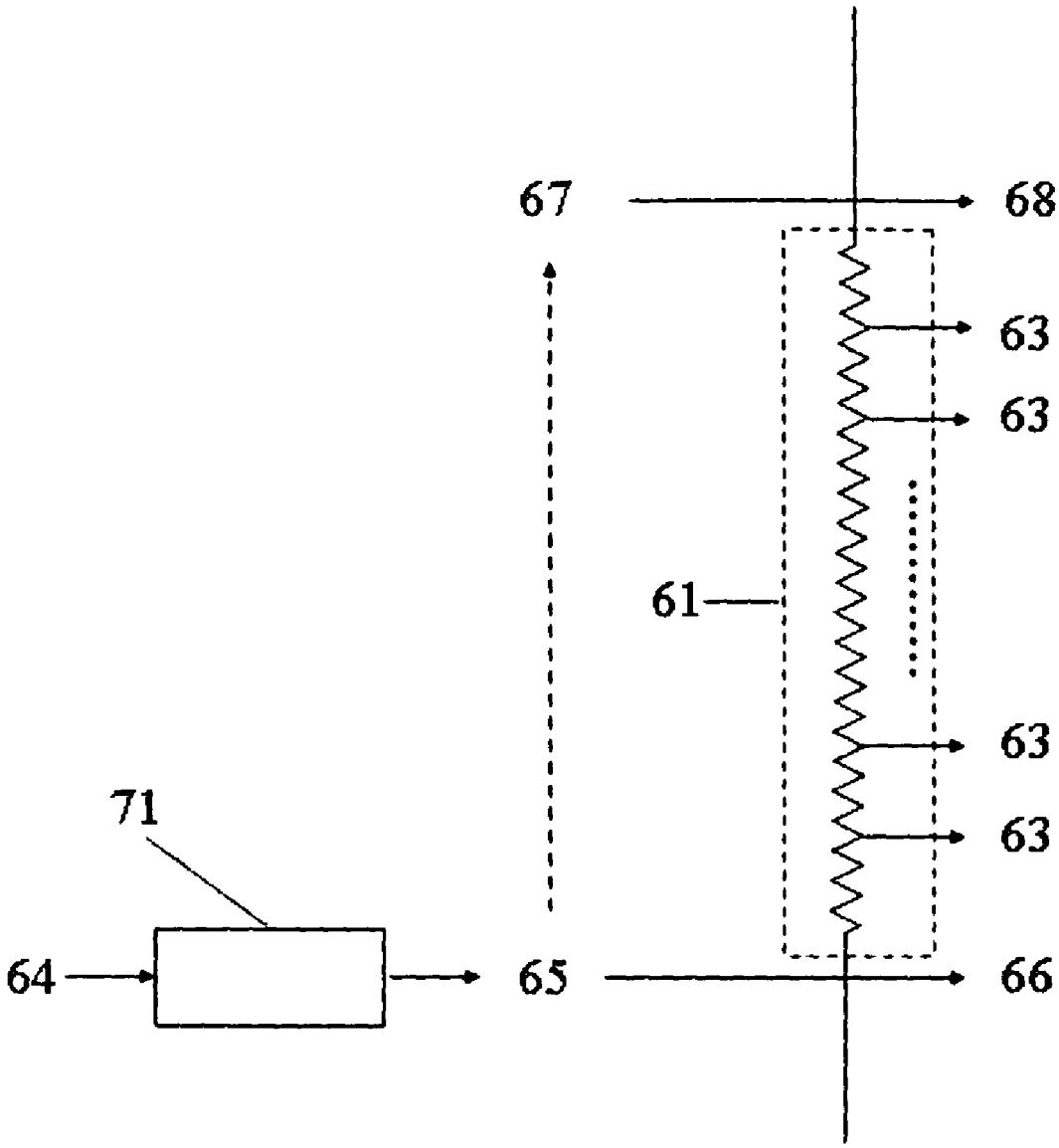
FIG. 7 is a diagram illustrating another modulation unit according to the present invention.

FIG. 7 illustrates another modulation unit according to the present invention, comprising serial-connected resistors 61 and a DC converting circuit 71 wherein the DC converting circuit receives an external voltage signal 64 and outputs a lowest voltage 65 to one terminal of the serial-connected resistors 61 according to the voltage level of the external voltage value 64. As mentioned above, a set of voltages including the highest output voltage point 68, the lowest output voltage point 66, and a plurality of voltage bias points 63 can increases or decreases simultaneously by adjusting the lowest input voltage 65. Thus, the signal transformation curve is shifted vertically according to the input voltage 65.

Figure 8:
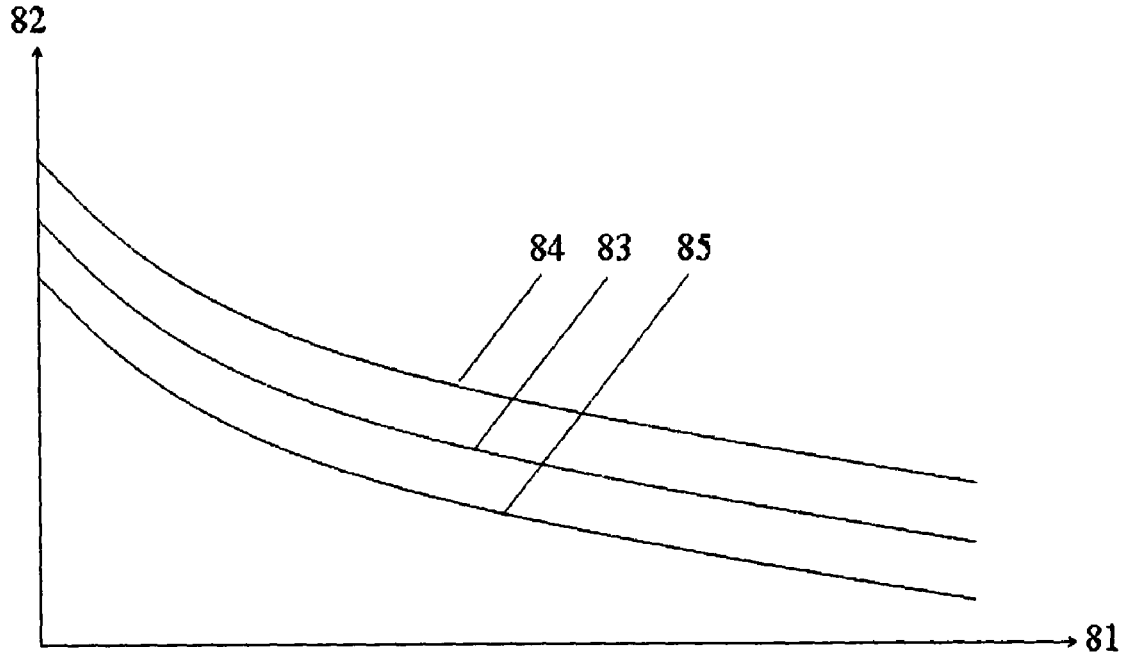
FIG. 8 is a graph illustrating the signal transformation curve in a coordinate with a modulation unit according to the present invention.

FIG. 8 is a graph illustrating the signal transformation curve in a coordinate with a modulation unit according to the present invention wherein the horizontal axis represents an input signal 81, the vertical axis represents an output signal 82 and a signal transformation curve 83 is a Gamma curve represents the relationship between the input signal 81 and output signal 82. While the modulation unit receives an increasing external voltage signal, the output voltage increases, too. Therefore, the signal transformation curve 83 shifts upward to the signal transformation curve 84; while the modulation unit receives a decreasing external voltage signal, the output voltage decreases, too. Therefore, the signal transformation curve 83 shifts downward to the signal transformation curve 85. According to the descriptions mentioned above, the present invention provides a modulation unit for manipulating the signal transformation curve with wide range instead of the small variation of signal transformation curve in prior art and further improves the quality of flat panel display devices apparently.

Although the foregoing discussions and disclosures describe merely exemplary embodiments of the present invention, it is not limited to such details since anyone of ordinary skill in the art can make modifications and changes without departing from the spirit and scope of the present invention. The features and advantages of the present invention will be apparent upon the description and claims.

What is claimed is:

1. A flat panel display device structure, comprising:

a plurality of pixels, each of the pixels containing a thin film transistor and a light generation device, wherein the drain of the thin film transistor couples with the light generation device; and a modulation unit having an input receiving an input signal and an output coupled to the gate terminal of the thin film transistor to supply an output signal thereto, said output signal relating to said input signal in accordance with a signal transformation curve of a predetermined shape, said modulation unit including an adjustment mechanism operating to translate said signal transformation curve vertically according to the voltage level of an external voltage signal, thereby tuning the brightness of the pixel, wherein said predetermined shape of said signal transformation curve remains substantially unchanged during said vertical translation thereof, wherein the voltage level of said external voltage signal is adjustable by a voltage divider having a single adjustable resistor, thereby allowing said adjustment mechanism to translate said signal transformation curve vertically accordingly;

wherein there is only a single external voltage signal in said modulation unit;

wherein there is only one adjustable resistor in the voltage divider.

2. The flat panel display device structure according to claim 1, wherein the light generation device is an organic light emitting diode (OLED).

3. The flat panel display device structure according to claim 1, wherein the modulation unit is contained in a driver integrated circuit (IC).

4. The flat panel display device structure according to claim 1, wherein the modulation unit is contained in a chip containing digital and analog circuits.

5. The flat panel display device structure according to claim 1, wherein the signal transformation curve is a Gamma curve.

6. The flat panel display device structure according to claim 1, wherein the vertical translation is an upward movement.

7. The flat panel display device structure according to claim 1, wherein the vertical translation is a downward movement.

8. The flat panel display device structure according to claim 1, wherein said signal transformation curve assumes a specified position in a coordinate system formed of a vertical axis representing said output signal and of a horizontal axis representing said input signal.

9. The flat panel display device structure according to claim 8, wherein said vertical translation is in accordance with the vertical axis direction of the coordinate system.

10. A flat panel display device structure, comprising:

a plurality of pixels, each of the pixels containing a thin film transistor and a light generation device, wherein the drain of the thin film transistor couples with the light generation device; and a modulation unit having an input receiving an input signal and an output coupled to the gate terminal of the thin film transistor to supply an output signal thereto, said output signal relating to said input signal in accordance with a signal transformation curve of a predetermined shape, said modulation unit including an adjustment mechanism having a single adjustable resistor within a voltage divider for defining a lower voltage level, a higher voltage level, and a constant voltage difference between the lower voltage level and the higher voltage level, whereby said adjustment mechanism operates to translate said signal transformation curve vertically, thereby tuning the brightness of the pixel, wherein said predetermined shape of said signal transformation curve remains substantially unchanged during said vertical translation thereof;

wherein there is only a single external voltage signal in said modulation unit;

wherein there is only one adjustable resistor in the voltage divider.

* * * * *